US006992299B2

(12) United States Patent
Lee et al.

(10) Patent No.: US 6,992,299 B2
(45) Date of Patent: Jan. 31, 2006

(54) METHOD AND APPARATUS FOR AERODYNAMIC ION FOCUSING

(75) Inventors: Edgar D. Lee, Highland, UT (US); Milton L. Lee, Pleasant Grove, UT (US); Alan L. Rockwood, Provo, UT (US); Li Zhou, Provo, UT (US)

(73) Assignee: Brigham Young University, Provo, UT (US)

( * ) Notice: Subject to any disclaimer, the term of this patent is extended or adjusted under 35 U.S.C. 154(b) by 57 days.

(21) Appl. No.: 10/739,949

(22) Filed: Dec. 18, 2003

(65) Prior Publication Data

US 2004/0206910 A1 Oct. 21, 2004

Related U.S. Application Data

(60) Provisional application No. 60/433,993, filed on Dec. 18, 2002.

(51) Int. Cl.
*H01J 49/24* (2006.01)

(52) U.S. Cl. ..... 250/396 R; 250/423; 250/281; 250/282; 250/283; 250/288

(58) Field of Classification Search ..... 250/281, 250/282, 283, 288, 428 R, 424, 396 R
See application file for complete search history.

(56) References Cited

U.S. PATENT DOCUMENTS

| | | | | |
|---|---|---|---|---|
| 4,121,099 | A | 10/1978 | French et al. | |
| 4,861,988 | A | 8/1989 | Henion et al. | |
| 5,115,131 | A | 5/1992 | Jorgenson et al. | |
| 5,352,892 | A | 10/1994 | Mordehai et al. | |
| 5,412,208 | A | 5/1995 | Covey et al. | |
| 5,432,343 | A | 7/1995 | Gulcicek et al. | |
| 5,747,799 | A | 5/1998 | Franzen | |
| 5,838,002 | A | 11/1998 | Sheehan | |
| 6,278,111 | B1 | 8/2001 | Sheehan et al. | |
| 6,396,064 | B1 * | 5/2002 | Danilatos | 250/441.11 |

FOREIGN PATENT DOCUMENTS

WO WO9534089 12/1995

OTHER PUBLICATIONS

"A New Technique for Decomposition of Selected Ions in Molecule Ion Reactor Coupled With Ortho–Time–of–Flight Mass Spectrometry", article written by A. Dodonov et al. for *Rapid Communications in Mass Spectrometry*, vol. II, 1997, pp. 1649–1656.

"A Novel Design for an Electrospray/Time–of–Flight Mass Spectrometer", article written by Jacqueline C. Fabbi et al., p. 51.

"A Novel Ion Funnel for Focusing Ions at Elevated Pressure Using Electrospray Ionization Mass Spectrometry", article written by Scott A. Shaffer et al. for *Rapid Communications in Mass Spectrometry*, vol. 11, pp. 1813–1817.

"A Segmented Radiofrequency–Only Quadrupole Collision Cell for Measurements of Ion Collision Cross Section on a Triple Quadrupole Mass Spectrometer", article written by Gholamreza Javahery et al. for *American Society for Mass Spectrometry*, 1997, pp. 697–702.

(Continued)

*Primary Examiner*—John R. Lee
*Assistant Examiner*—David A. Vanore
(74) *Attorney, Agent, or Firm*—Morriss O'Bryant Compagni, P.C.

(57) ABSTRACT

A method and apparatus for focusing ions for delivery to an ion detection device using an aerodynamic ion focusing system that uses a high-velocity converging gas flow at an entrance aperture to focus an ion plume by reducing spreading and increasing desolvation of ions, and wherein a voltage is applied to at least a portion of the aerodynamic ion focusing system to assist in the focusing and delivery of ions to the ion detection device.

23 Claims, 7 Drawing Sheets

OTHER PUBLICATIONS

"An Atmospheric Pressure Ion Lens That Improves Nebulizer Assisted Electrospray Ion Sources", article written by Bradley R. Schneider et al., for *American Society for Mass Spectrometry*, 2002.

"An Atmospheric Pressure Ion Lens to Improve Electrospray Ionization at Low Solution Flow–Rates", article written by Bradley R. Schneider et al. for *Rapid Commun. Mass Spectrom*, 2001, pp. 2168–2175.

"Capillary Zone Electrophoresis–Mass Spectrometry Using an Electrospray Ionization Interface", article written by Richard D. Smith et al. for *Anal. Chem.*, 1988, pp. 436–441.

"Characterization of an Improved Electrodynamic Ion Funnel Interface for Electrospray Ionization Mass Spectrometry", article written by Scott A. Shaffer et al., for *Anal. Chem.*, 1999, pp. 2957–2964.

"Collisonal Focusing Effects in Radio Frequency Quadrupoles", article writted by D. J. Douglas et al. for *American Society for Mass Spectrometry*, 1992, pp. 398–408.

"Design and Implementation of a New Electrodynamic Ion Funnel", article written by Taeman Kim et al., for *Anal. Chem.*, 2000, pp. 2247–2255.

"Electrified Droplet Fission and the Rayleigh Limit", article written by Daniel C. Taflin et al. for *Langmuir*, 1989, pp. 376–384.

"Electrospray Interface for Liquid Chromatographs and Mass Spectrometers", article written for *Anal. Chem.*, 1985, pp. 675–679.

"Electrospray Ion Source. Another Variation on the Free–Jet Theme", article written for *J. Phys Chem.*, 1984, pp. 4451–4459.

"Electrospray Ionization for Mass Spectrometry of Large Biomolecules", article written for *Science*, vol. 246, Oct. 6, 1989, pp. 64–70.

"Electrospray Ionization Time–of–Flight Mass Spectrometric Detection for Fast Liquid Phase Separations", article written by Julia M. Lazar et al. for *American Laboratory*, Feb. 2000, pp. 110–119.

"Improved Transmission From Atmospheric Pressure to High Vacuum Using a Multicapillary Inlet and Electrodynamic Ion Funnel Interface", written by Taeman Kim et al. for *Anal. Chem*, 2000, pp. 5014–5019.

"Incorporation of a Venturi Device in Electrospray Ionization", article written by Li Zhou et al., for *Anal. Chem.*, 2003, pp. 5978–5983.

"Macrocyclic Chemistry in the Gas Phase: Intrinsic Cation Affinities and Complexation Rates for Alkali Metal Cation Complexes of Crown Ethers and Glymes", article written by In–Hou Chu et al. for the *American Chemical Society*, 1993, pp. 5736–5744.

"Mass Spectrometry", article written by A.L. Burlingame et al. for *Anal. Chem.*, 1998, pp. 647–716.

"Matrix Effect on the Analysis of Oligonucleotides by Using a Mass Spectrometer With a Sonic Spray Ionization Source", article written by Min Huang, et al. for *Analytical Sciences*, Oct. 2001, vol. 17, pp. 1179–1182.

"Multi–Charged Oligonucleotide Ion Formation in Sonic Spray Ionization", article written by Min Huang et al. for *Analytical Sciences*, Apr. 2002, vol. 18, pp. 385–390.

"Nano–Electrospray Ionization Mass Spectrometry: Addressing Analytical Problems Beyond Routine", article written by M. Karas et al. for *Presenius J Anal. Chem*, 2000, pp. 669–676.

"On Cluster Ions, Ion Transmisson, and Linear Dynamic Range Limitations in Electrospray (Ionspray) Mass Spectrometry", article written by D. R. Zook et al., *International Journal of Mass Spectrometry and Ion Processes* 162, 1997, pp. 129–147.

"On–Line Mass Spectrometric Detection for Capillary Zone Electrophoresis", article written by Mikkers et al. for *Anal. Chem.*, 1987, pp. 1230–1232.

"Semitron® ESD 420 PEI Specifications", product specification sheet taken from www.boedeker.com (Website for Boedeker Plastics, Inc.) Nov. 18, 2003.

"Semitron® ESD 520HR PAI Specifications", product specification sheet taken from www.boedeker.com (Website for Boedeker Plastics, Inc.) Nov. 18, 2003.

"Sonic Spray Ionization Method for Atmospheric Pressure Ionization Mass Spectrometry", article written by Atsumu Hirabayashi et al. for *Anal. Chem.*, 1994, pp. 4557–4559.

"Sonic Spray Mass Spectrometry", article written by Atsumu Hirabayashi et al. for *Anal. Chem.*, 1995, pp. 2878–2882.

"Subatmospheric Electrospray Interface for Coupling of Microcolumn Separations With Mass Spectrometry", article written by Frantisek Foret et al. for *Electrophoresis*, 2000, pp. 1363–1371.

"Zeptomole–Sensitivity Electrospray Ionization–Fourier Transform Ion Cyclotron Resonance Mass Spectrometry of Proteins", article written by Mikhail E. Belov et al. for *Anal. Chem.*, 2000, pp. 2271–2279.

* cited by examiner

METHOD AND APPARATUS FOR AERODYNAMIC ION FOCUSING

PRIORITY CLAIM

The present invention claims priority to previously filed provisional application Ser. No. 60/433,993, filed on Dec. 18, 2002.

BACKGROUND OF THE INVENTION

1. Field of the Invention

This invention relates generally to the delivery of ions to ion detection devices. More specifically, the invention describes a method and apparatus for improving the ability to focus ions after they are formed by using a front-end device so that a greater number of ions can be directed to an ion detection device for detection or further analysis.

2. Description of Related Art

The prior art is replete with improvements in systems that enable the formation of ions, and in the detection and analysis thereof. However, one of the difficulties of performing ion detection and analysis is the task of delivering a large quantity of ions to an ion detection or analysis device. The ions are difficult to direct to an appropriate orifice of an ion detection device for various reasons that are known to those skilled in the art. Nevertheless, the more ions that can be delivered to the ion detection device, the more "sensitive" or accurate the results will be. Such devices include an electron multiplier, Faraday plate, ion mobility spectrometer, and a time-of-flight mass spectrometer. In general, the present invention should be considered to apply to any device that needs to perform ion detection and/or analysis, whatever that device might be. But all of these devices should be considered to fall within the single descriptive term of "ion detection device".

An important technique referred to as "electrospray ionization" was developed in order to improve the process of delivering ions to an ion detection device. For example, in electrospray ionization, a liquid sample is directed through a free end of a capillary tube or orifice, wherein the tube is coupled to a high voltage source. In general, the free end of the capillary or electrospray sprayer tip is spaced apart from an orifice plate or capillary that has a sampling orifice that leads to a vacuum chamber of the ion detection device. The orifice plate is also coupled to the high voltage source. The electric field generates a spray of charged droplets, and the droplets evaporate to produce ions.

Electrospray ionization has grown to be one of the most commonly used ionization techniques for mass spectrometry, and efforts continue to improve its performance. Typically, the electrospray tip must be very close to the orifice of the ion detection device in order to maximize the conduction of ions from the electrospray tip into the ion detection device. However, due to space-charge repulsion, most ions never reach the sampling orifice.

Nevertheless, the significance of electrospray ionization for mass spectrometry has recently been emphasized by the rewarding of the Nobel Prize for work in this area. Electrospray ionization is most recognized today for its application to biomolecules where high "sensitivity is of paramount importance." It should be remembered that throughout this document, sensitivity more accurately refers to the total number of ions that can be delivered to an ion detection device. Electrospray ionization is known for its high sensitivity; however, the present invention will demonstrate that this process has the potential of becoming even more sensitive.

It is now known that a major limitation in sensitivity when using electrospray ionization and with ion detection devices is due to low ion transmission from the electrospray ionization source through the atmosphere-to-vacuum sampling orifice into an inner chamber of an ion detection device such as a mass spectrometer. Although the ionization efficiency approaches 100%, the typical ion transmission efficiency from the electrospray ionization source to the extraction region of the ion detection device is only 0.01–0.1%.

When dealing with ion detection devices, it is important to look closely at the process of ion delivery. During the process of electrospray ionization, analyte ions are generated at atmospheric pressure and transferred into a low-pressure extraction region of the mass spectrometer via a conductance-limiting aperture located in a high pressure region. Gas-phase collisions and Coulombic repulsion that are inevitably involved result in expansion of the ion cloud, directing ions away from the extraction region of the mass spectrometer, thus decreasing the sensitivity. Although conventional ion optic devices based on Coulombic effects can effectively focus ions in vacuum, they are largely ineffective in avoiding or reversing ion-cloud expansion generated by gas-phase collisions and Coulombic repulsion at high pressures.

To assist in desolvation and transmission of ions from the electrospray sprayer tip to the sampling capillary inlet, Henion et al. taught an "ion spray" device in which a high velocity sheath flow nebulizing gas was directed past the electrospray sprayer tip. By optimizing the flow rate for focusing and desolvating the electrosprayed ions, an approximately 30% increase in ion signal intensity was obtained as compared to a relatively low flow rate. However, no indication was given as to ion signal improvement compared to a conventional electrospray ionization source without the nebulizer-assisted device.

The prior art as taught by Covey et al. teaches that an electrospray ionization source in which a heated gas flow was directed at an angle toward the flow axis of a nebulizer-assisted electrospray source, and intersected the droplet flow at a region upstream of the sampling orifice of the mass spectrometer. The intersecting gas flows mixed with the droplet flow in a turbulent fashion, and helped to desolvate ions in the droplets and move them toward the sampling orifice. The intersecting flow device reportedly provided an increase in sensitivity of over 10 times, and significantly lowered the background in the resulting mass spectra. However, it was necessary to carefully control the two flows and the angle between them for stability of the electrospray. Thus, better performance may be difficult to obtain and maintain.

The prior art as taught by Smith et al. has improved the sensitivity of electrospray ionization by designing a so-called "ion funnel" in the first vacuum stage of the mass spectrometer between the sampling capillary inlet, and a skimmer that is internal to a mass spectrometer. This ion funnel consists of a series of cylindrical ring electrodes of progressively smaller internal diameters. By co-applying radio frequency (RF) and direct current (DC) electric fields on the electrode series, the ion cloud is more effectively focused and the Coulombic-driven ion cloud expansion is reduced under pressures of $10^{-4}$ up to 9 Torr. Thus, ions are more efficiently captured, focused and transmitted as a collimated ion beam from the sampling orifice to the skimmer. Over an order of magnitude increase in ion signal intensity was reported as compared to a conventional electrospray ionization source.

A recent improvement to this ion funnel is the use of a multi-capillary inlet. With the combination of multicapillary inlet and ion funnel, Kim et al. reported ion transmission efficiencies that are 23 times greater than can be obtained with conventional electrospray ionization ion optics. However, the ion funnel improves ion transport only at reduced pressures and cannot be applied at atmospheric pressure conditions between the electrospray tip and sampling nozzle where most ion losses occur.

Until now, few users have reported effective methods of improving ion signals in the high pressure region between the sprayer and the sampling orifice of the mass spectrometer. One group of users placed a ring electrode downstream from an electrospray ionization sprayer to focus ions into the mass spectrometer. Another group of users employed a focusing ring at atmospheric pressure on the inner wall of a heated glass capillary interface for electrospray ionization. Still other groups reported similar designs of a heated silica capillary to assist in desolvation in which end plate and cylindrical lenses were mentioned. These lenses were located at substantial distances from both the sprayer and the inlet orifice of the heated capillary. According to these users, the electrode rings were useful; however, no mention was made concerning how much they improved ion signal intensities. Finally, another group of users described the use of an oblong-shaped stainless steel electrode ring that was connected to a high voltage power supply, and placed near the electrospray tip at a potential less than that of the sprayer. It was reported that this lens produced a 2-fold increase in ion signal intensity and a 2-fold reduction in the signal relative standard deviation (RSD). Other advances included an increase in formation of multiple charged ions, less critical positioning of the sprayer for optimum performance, and more ease in use compared to the ion funnel and intersecting flow devices.

An alternative to focusing the electrospray ion beam toward the sampling orifice is to place the electrospray tip as close to the sampling nozzle as possible so that a larger portion of the spray enters the vacuum region. Low flow rates from small-bore electrospray ionization tips are desirable for stability of the "Taylor cone" and production of fine electrospray droplets. This combination has been accomplished using microspray and, especially, nanospray sources. The improvement in response can be explained by the fact that sprayed droplets are already small enough to produce gas-phase ions directly. Analyte concentrations down to low picomolar can be easily sprayed without sheath flow or pneumatic assistance for mass spectrometer detection.

For this reason, microspray and nanospray sources can be operated with the electrospray tip very close to the sampling orifice of the mass spectrometer. However, the closeness is limited by the electrical discharge threshold between the high voltage sprayer and the nozzle counter electrode, which is dependent on the voltage applied to the electrospray ionization sprayer tip. In order to overcome these limitations, different groups of users reported low-pressure electrospray devices, in which analyte solutions were electrosprayed inside the vacuum chamber at reduced pressures. Unfortunately, incomplete desolvation largely offset any improvement in increased sample introduction. Moreover, when the electrospray device was positioned in a very-low-pressure region, one group of users reported significant loss of analytes and fine droplets on the walls of the vacuum chamber and heated transfer line, thus, seriously decreasing the sensitivity.

It is generally believed that electrospray ionization technology has reached the point where modifications produce only minor gains in ion transmission in atmospheric pressure regions of electrospray ionization sources. Accordingly, what is needed are new approaches that will take advantage of the high sensitivity that is potentially available but not yet exploited by state of the art techniques in ion delivery.

BRIEF SUMMARY OF THE INVENTION

It is an object of the present invention to provide an improved method and apparatus for delivering ions to a sampling orifice of an ion detection device to thereby improve sensitivity by increasing the total number of ions that are delivered thereto.

In a preferred embodiment, the present invention is a method and apparatus for focusing ions for delivery to an ion detection device using an aerodynamic ion focusing system that uses a high-velocity converging gas flow to focus an ion plume by reducing spreading and increasing desolvation of ions, and wherein a voltage is applied to at least a portion of the aerodynamic ion focusing system to assist in the focusing and delivery of ions to the ion detection device.

In a first aspect of the invention, a voltage gradient is created in the aerodynamic ion focusing device to thereby assist in focusing and conduction of ions.

In a second aspect of the invention, non-diverging gas flow reduces spreading of an electrospray plume of ions.

In a third aspect of the invention, converging gas flow reduces spreading of an electrospray plume of ions.

In a fourth aspect of the invention, concentric gas flow reduces spreading of an electrospray plume of ions.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention. It is to be understood that the following description is only exemplary of the principles of the present invention, and should not be viewed as narrowing the claims which follow.

Figure 1:
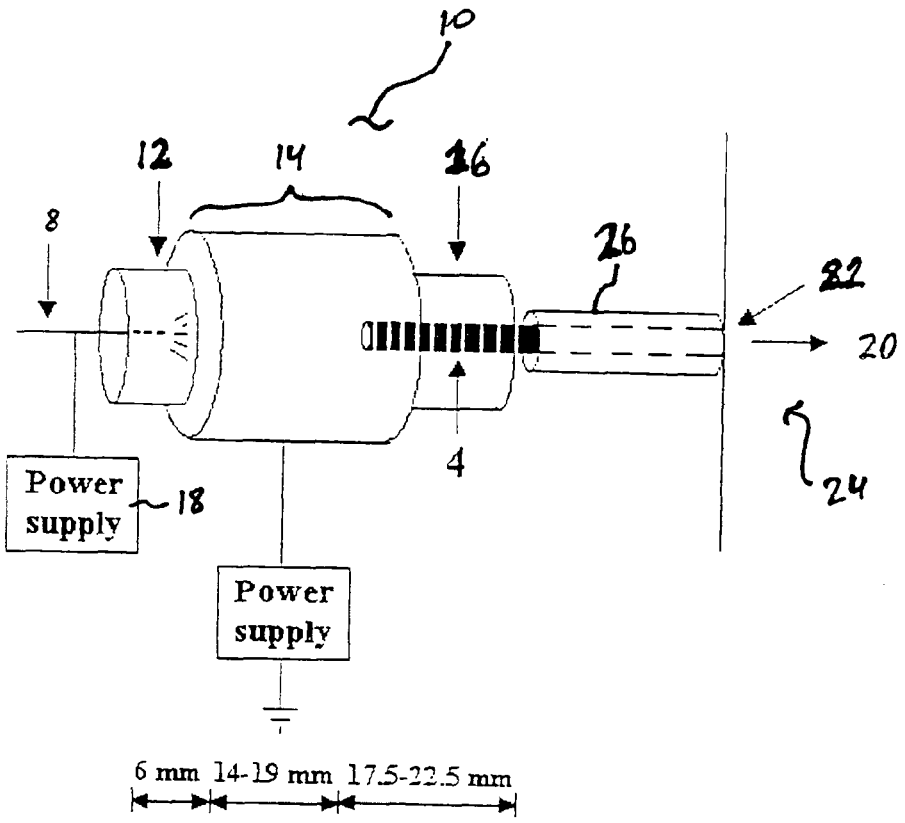
FIG. 1 is a perspective diagram of the elements of a first embodiment made in accordance with the principles of the present invention.

FIG. 1 is a provided as an overview of the method and apparatus taught by the present invention for the focusing and delivery of ions to an ion detection device. The improvements in the system result in substantial gains in the number of ions that are capable of being delivered to an ionic detection device.

FIG. 1 is a perspective view of the present invention. An aerodynamic ion focusing device 10 is shown having an entrance aperture 12, a main body 14, and an exit aperture 16. A power supply 18 is indicated as applying a voltage. Note that an electrospray tip 8 is shown as being partially inserted into the entrance aperture 12. An ion detection device 20, such as a time-of-flight mass spectrometer, is shown as having a sampling orifice 22 at a junction between a vacuum chamber 24 of the ion detection device 20 and a nozzle or capillary inlet 26 that extends outwards from the ion detection device and towards the aerodynamic ion focusing device 10. This document also discusses an electrospray tip. An electrospray tip 8 creates ions that are "sprayed" near or into the entrance aperture 12 of the aerodynamic ion focusing device 10.

The electrospray tip 8 is not considered an element of the apparatus of the present invention, but is important because of the plume of ions that it generates and delivers to the aerodynamic ion focusing device 10. Other sources of ions would include atmospheric pressure chemical ionization (APCI), and photoionization. These are examples only, and should not be considered a limiting factor.

It should be noted at the outset that the sampling orifice 22 of the ion detection device 20 does not need to have a capillary inlet 26. The sampling orifice 22 may have any configuration of shaped walls around it to assist in directing ions into the ion detection device 20. Accordingly, the presence of the capillary inlet 26 should not be considered a limiting factor, but is simply an illustration of one possible embodiment.

The critical aspects of the invention relate to the ability to use the flow of gas into the aerodynamic ion focusing device 10 to focus an ion plume from an electrospray tip or other source of ions near the entrance aperture 12. A second critical aspect of the invention is the ability to apply a voltage to the aerodynamic ion focusing device 10 and thereby generate a voltage gradient along a portion of the length thereof that can also be used to focus the ion plume.

Figure 2:
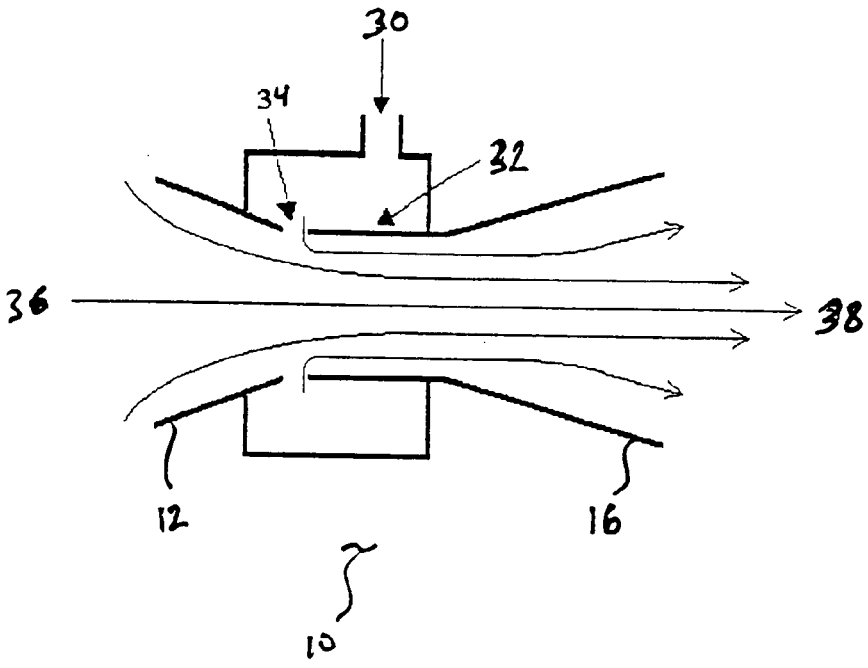
FIG. 2 is a cut-away profile view of the aerodynamic ion focusing device of the present invention.

FIG. 2 is provided as a cut-away perspective view of the internal structure of one possible configuration of the aerodynamic ion focusing device 10. Significant features include the entrance aperture 12, the exit aperture 16, a nitrogen gas supply inlet 30, an annular chamber 32, an annular gap 34, induced input airflow lines 36, and resulting output airflow lines 38. These features illustrate the aspect of the aerodynamic ion focusing device to provide improved performance only because of gas flow.

It is significant to consider that electrospray ionization has grown to be one of the most commonly used ionization techniques for ion detection. Typically, an electrospray tip must be very close to a sampling orifice of an ion detection device in order to maximize the conduction of ions from the electrospray tip into the ion detection device. However, because of space-charge repulsion, most ions never reach the sampling orifice. The aerodynamic ion focusing device 10 shown in FIG. 2 is a device based at least upon venturi and coanda effects. As a front-end for an ion detection device, the present invention improves upon the number of ions that are delivered thereto. Thus, the sensitivity of the ion detection is considered to be improved.

For example, when a series of reserpine solutions were monitored using mass spectrometry, an over 5-fold increase in ion intensity was measured for a separation distance of 14 mm between the electrospray tip and the capillary inlet, as compared to when the electrospray tip was in its normal position 1 mm in front of the capillary inlet without the aerodynamic ion focusing device. When a voltage was applied to the aerodynamic ion focusing device to further assist in focusing electrosprayed ions, approximately an 18-fold increase in ion intensity was obtained. In addition, a 34-fold improvement in method detection limit was observed.

While the aerodynamic ion focusing device 10 of FIG. 2 is based upon the principles of venture and coanda effects, it should be explained that the present invention does not need to use either of these principles in order to operate. A gas flow that can be made to perform the function of drawing ions into a desired trajectory for delivery to an ion detection device can be created using other means.

For example, consider a device that creates suction at the exit aperture 16 to draw the ions into the aerodynamic ion focusing device 10. For that matter, even a mildly diverging gas flow into the entrance aperture 12 of the aerodynamic ion focusing device 10 could also perform the desired function. This is because a stream of gas that is rapidly moving past the electrospray tip is sufficient to reduce the divergence of the ion plume. The moving gas pulls the ion plume into a long and thin ion plume. This can be true even if the gas flow is mildly diverging. The important point to understand is that the gas stream causes the ion plume to be drawn into a thin plume, which reduces space-charge and the subsequent expansion of the ion plume.

The nature of the trajectory has not been specifically addressed. However, if the trajectory is not linear, one useful purpose of such a trajectory would be to separate spray droplets from the ion plume. Therefore, the trajectory should not be considered to be limited to only a linear one, as there are advantages to non-linear trajectories.

Figure 3:
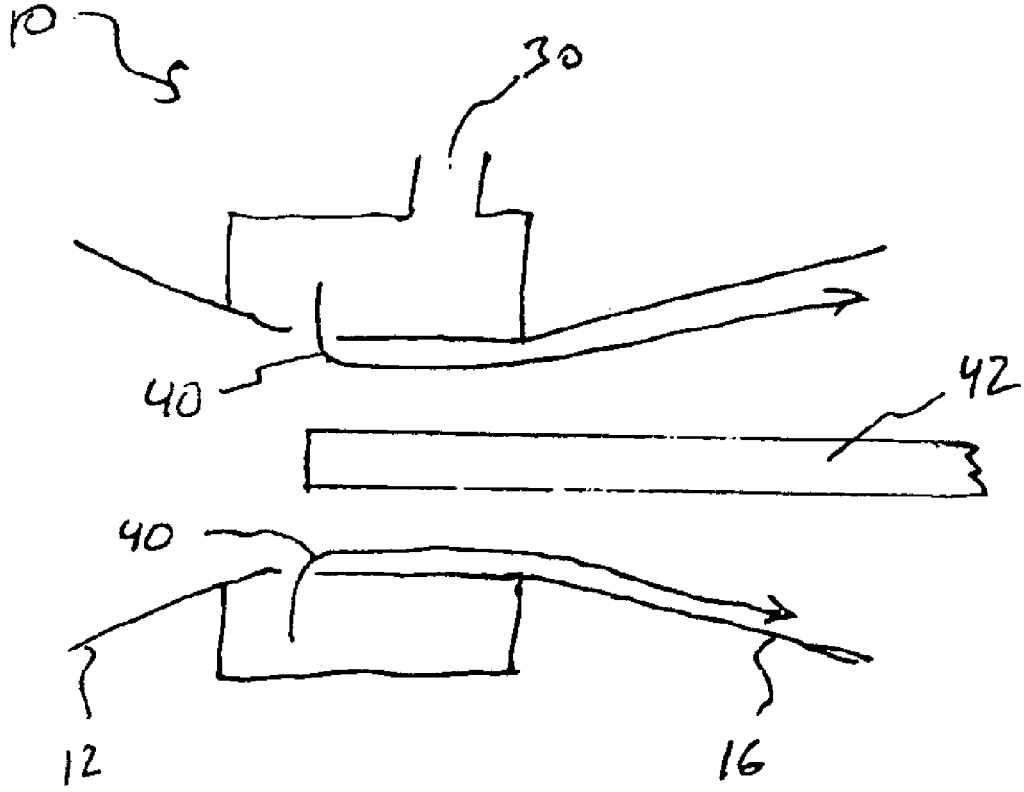
FIG. 3 is a cut-away profile view of the aerodynamic ion focusing device that illustrates desired air flow that is used to create a trajectory for ions that concentrates them for delivery to an ion detection device.

FIG. 3 is provided to explain the improved operational aspects of the aerodynamic ion focusing device 10 because of the creation of a desired gas flow. The inert gas nitrogen is used to create the desired flow of gases into and through the aerodynamic ion focusing device 10. The desired flow of gases is any flow that will result in a confinement of an electrospray ion plume at the entrance aperture 12 of the aerodynamic ion focusing device 10. Increased confinement of the electrospray ion plume is more likely to result in a larger number of ions that are deliverable and delivered to the ion detection device 20.

While nitrogen gas has been used, other gases can also be used, including helium, argon, and air. What is important is the function being performed by the gas, and that is to create a gas flow that drives an ion plume into a desired trajectory so that a larger number of ions can ultimately reach an ion detection device.

In the present embodiment of the invention, the desired flow of gases that result in increased confinement of the electrospray ion plume is created by the shape of the aerodynamic ion focusing device 10, and the nature of the gas flow therethrough. Thus for example, a coanda effect on the nitrogen gas being introduced through the annular gap 34 is demonstrated when the gas immediately changes a direction of flow so as to stay relatively flush against and therefore to generally follow the contours of the inner surface of the aerodynamic ion focusing device 10. This feature of the gas is indicated by nitrogen gas flow lines 40 in FIG. 3. The flow of the nitrogen gas will thus cause the electrospray ion plume at the entrance aperture 12 to be concentrated along a trajectory that is shaped and determined by the gas.

For example, in this embodiment, the electrospray ion plume is likely to travel along a center or midpoint of the nitrogen gas flow, as shown by the trajectory indicated at 42. In this embodiment, trajectory 42 should generally be considered to be coaxial with the entrance and exit apertures 12, 16 because of the symmetry of the aerodynamic ion focusing device 10 and the resulting gas flow therethrough that is induced by the flow of the nitrogen gas.

For example, the ion plume will be restricted because of the convergence of the air that is being pulled into the aerodynamic ion focusing device 10 at the entrance aperture 12 because of the flow of the nitrogen gas. In addition, the nitrogen gas flow can also be used to restrict the ion plume so as to be output in a planar structure. This feature of the present invention is thus determinable by the shape of the aerodynamic ion focusing device 10.

Ideally, an entrance to the capillary inlet 26 extending from the ion detection device 20 will be positioned along trajectory 42 in order to take advantage of the ions that have been confined to this trajectory. Experimental results have shown approximately a 100-fold increase in concentration of ions that can be delivered to the ion detection device 20.

It is a critical aspect of the invention to observe that the desired air flow into the entrance aperture 12 of the aerodynamic ion focusing device 10 can be characterized as a converging gas flow. This desired characteristic may also be classified more broadly as simply a non-diverging gas flow. As mentioned previously, even a mildly diverging gas flow, if properly directed, can create the desired effect on the ion plume. Another term that can be used to describe this desired gas flow is a concentric gas flow.

More specifically, the action of the high velocity nitrogen gas streaming down the exit aperture 16 of the aerodynamic ion focusing device 10 causes a pressure drop that induces a large flow of ambient air into the entrance aperture 12 of the aerodynamic ion focusing device 10. The net effect is that the aerodynamic ion focusing device 10 uses the energy from a small volume of compressed nitrogen gas to produce a large volume, large velocity, and low-pressure outlet gas flow 38. The volume of the outlet gas flow 38 can be as high as 100 times the supply flow, that is, 400 to 600 L $min^{-1}$. However, it should be remembered that these volumes are typical only for this particular aerodynamic ion focusing device shown here and may be different for different configurations of aerodynamic ion focusing devices 10, and should therefore not be considered a limiting factor.

Not only can increased concentration of the ion plume along trajectory 42 be obtained by creating a desired gas flow into the aerodynamic ion focusing device 10, it can be further increased through application of another aspect of the invention. Specifically, the use of a voltage gradient and the resulting electric field lines within the aerodynamic ion focusing device 10 can be used to enhance concentration of the electrospray ion plume at the entrance aperture 12. The presently preferred embodiment of the invention is thus an aerodynamic ion focusing device 10 that is capable of generating a voltage gradient along at least a portion thereof.

It should be noted that an increasing voltage gradient is defined herein as a voltage gradient that drives the ions towards a desired trajectory through the device, whatever the actual voltage applied may be.

Figure 4:
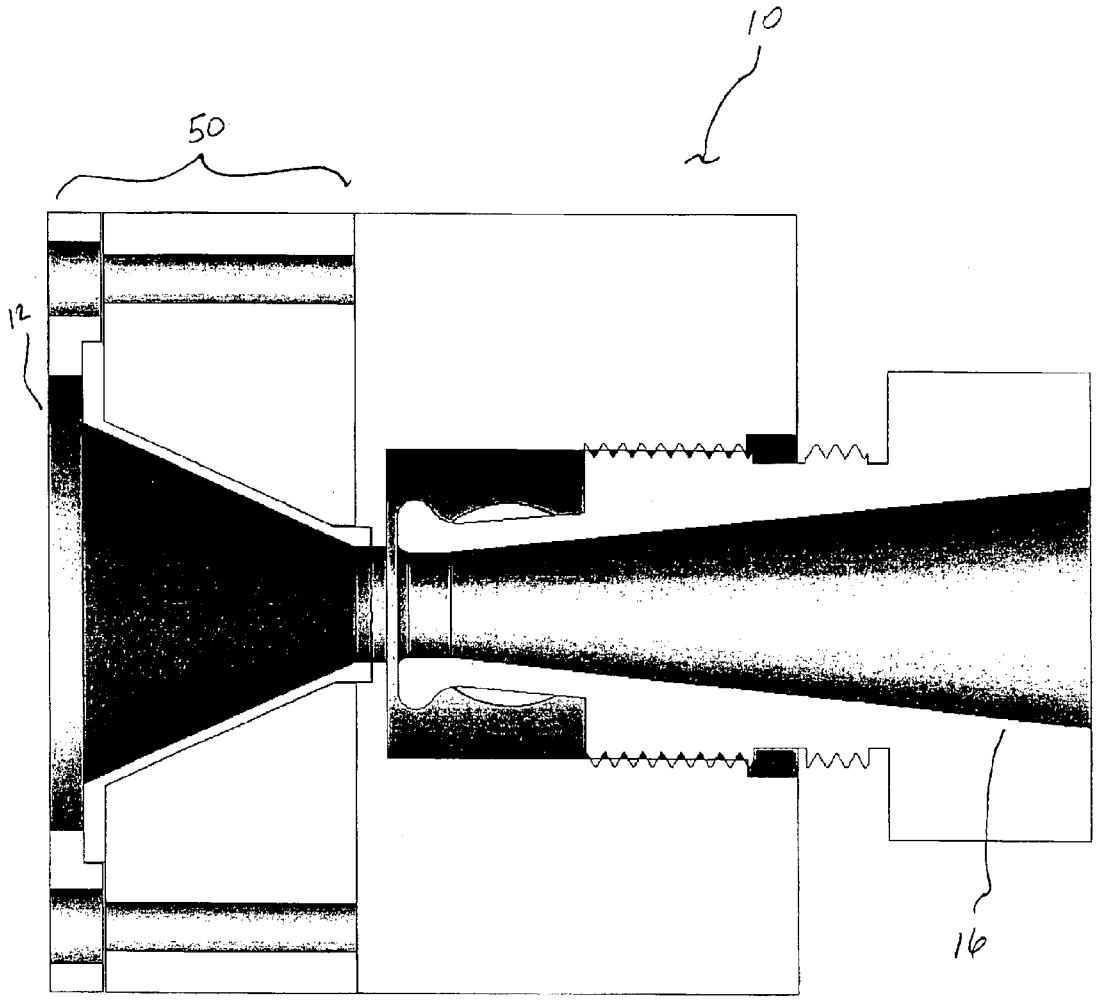
FIG. 4 is a cut-away profile view of the aerodynamic ion focusing device of FIG. 3 with more detail regarding a portion that has been modified to enable application of an electrical potential so as to thereby create a voltage gradient.
Figures 5A, 5B, 5C, 5D:
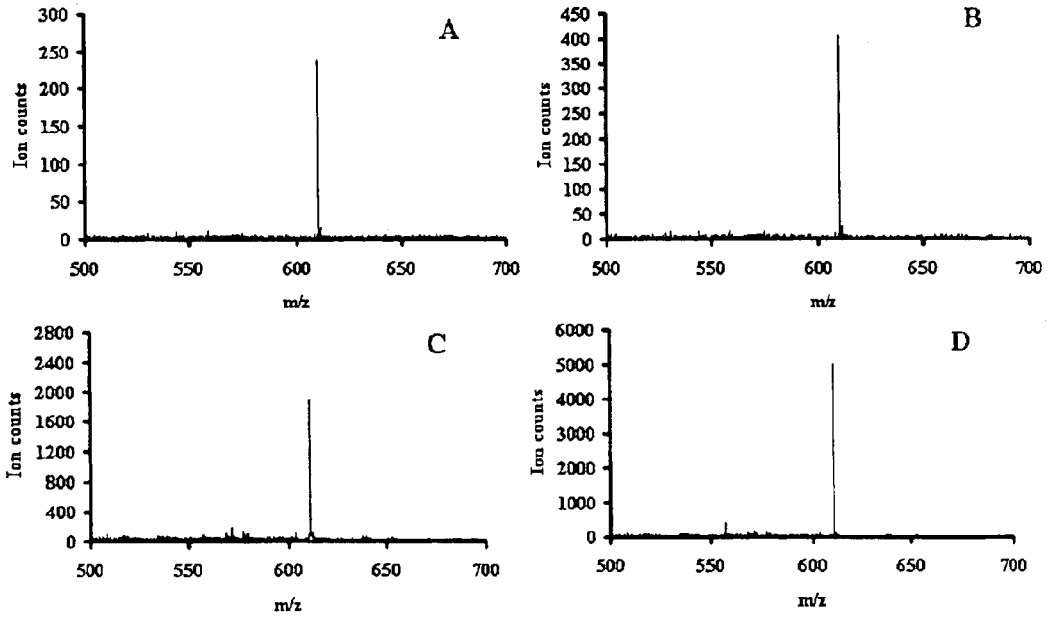
FIG. 5A is a mass spectra obtained without the aerodynamic ion focusing device.
FIG. 5B is a mass spectra obtained with the aerodynamic ion focusing device without convergent gas flow but with applied voltage.
FIG. 5C is a mass spectra obtained with the aerodynamic ion focusing device with convergent gas flow but without applied voltage.
FIG. 5D is a mass spectra obtained with the aerodynamic ion focusing device with convergent gas flow and with applied voltage.

Thus, the present invention includes the means for applying an electrical potential to at least a portion of the aerodynamic ion focusing device 10. FIG. 4 is provided as a cut-away schematic illustration of one embodiment of the aerodynamic ion focusing device 10 that is capable of having a voltage applied thereto. In this figure, the entrance aperture 12 is shown disposed within a portion 50 that has been modified so as to be at least slightly electrically conductive. The electrical conductivity is made possible by the introduction of conductive materials, such as carbon, that enable the application of an electrical potential across the portion 50.

It should be understood that a voltage gradient can be created within the aerodynamic ion focusing device 10 in various ways, and many may be appropriate in the present invention. For example, the conductivity of the materials used can be varied in order to obtain a voltage gradient. In addition, separate segments or rings could be disposed along a portion of the length of the aerodynamic ion focusing device 10. Conductive inks or other types of electrode traces might also be disposed at various intervals. What is important to the present invention is that a voltage gradient can be formed by producing a gradation in the resistivity of the material and/or a change in the cross sectional area of the material. Thus, all of these methods can be considered to be within the scope of the present invention.

There are many materials that are suitable for use as the slightly electrically conductive portion of the aerodynamic ion focusing device 10. These materials include PolyEther-Imide and PolyAmide-Imide. These materials are relatively highly resistive, but are sufficiently conductive to enable application of a voltage that results in creation of a voltage gradient. The voltage gradient was modeled in software to predict its characteristics, but this is not required in order to obtain a desired voltage gradient. Generally, the voltage gradient functions so as to further focus the electrospray ion plume being introduced into the aerodynamic ion focusing device 10.

The power supply 18 is used to apply the electrical potential across the portion 50. The size of the electrical potential applied to the aerodynamic ion focusing device 10 is easily determined through experimentation.

It is therefore useful to look at some experimental results that demonstrate the effectiveness of the present invention to perform as desired. To test the electrospray ion plume focusing aspect of the present invention, ion signal enhancements were studied.

A series of reserpine concentrations were analyzed under the conditions of (1) no aerodynamic ion focusing device 10, (2) with the aerodynamic ion focusing device 10 and applied voltage (1.9–2.0 kV), but no venturi-induced gas flow, (3) with the aerodynamic ion focusing device 10 and venturi-induced gas flow, but no applied voltage; and (4) with the aerodynamic ion focusing device 10, venturi-induced gas flow, and applied voltage. Ten determinations of each measurement were made for statistical considerations. The capillary interface was heated to 75° C.

In these experiments, a JAGUAR™ time-of-flight mass spectrometer with a homemade heated capillary inlet was used to test the ion focusing of the present invention. An aluminum air amplifier was re-machined out of stainless steel and disposed between an electrospray tip and capillary inlet of a mass spectrometer. Two high-voltage power supplies were connected to the electrospray tip source, aerodynamic ion focusing device 10, capillary inlet 26, and skimmer and set at 2.8 to 4.0 kV, 0.0 to 3.0 kV, 300 V, and 65 V, respectively. The aerodynamic ion focusing device 10 was grounded, except when a voltage was applied to the entrance aperture 12. The various reserpine solutions were introduced at an infusion rate of 1.5 $\mu$L min$^{-1}$.

FIGS. 5A–5D are a series of graphs that show examples of mass spectra obtained without the aerodynamic ion focusing device (5A), with the aerodynamic ion focusing device 10 without convergent gas flow but with applied voltage (5B), with the aerodynamic ion focusing device 10 with convergent gas flow but without applied voltage (5C), and with the aerodynamic ion focusing device 10 with convergent gas flow and with applied voltage (5D).

These experiments were performed with the electrospray tip axially disposed 6 mm inside the entrance aperture 12 of the aerodynamic ion focusing device 10, and a capillary inlet 26 was positioned 22.5 mm inside the exit aperture 16 of the aerodynamic ion focusing device (i.e., the electrospray tip was 14 mm from the capillary inlet 26 along the axial direction).

The greatest enhancement in ion signal intensity was observed when desired ambient air flow and applied voltage were used together in the aerodynamic ion focusing device 10. Using the aerodynamic ion focusing device 10 without convergent gas flow but with applied voltage, the ion signal intensity increased by over 50% as compared to when no aerodynamic ion focusing device was used at all. With gas flow through the aerodynamic ion focusing device 10 and no voltage applied, over a 5-fold increase (amplification factor) was obtained. When 1.9–2.0 kV was applied to the aerodynamic ion focusing device 10 with venturi-induced gas flow, an 18-fold increase in ion signal intensity was obtained.

To find the optimum positions of an electrospray tip and capillary inlet 26 as described above, the electrospray tip, aerodynamic ion focusing device 10, and capillary inlet 26 positions were axially modified relative to each other until the measured ion intensity was at a maximum. This was accomplished by moving the electrospray tip from 12 mm inside the entrance aperture 12 to 20 mm outside the entrance aperture at 1 mm increments and, at each increment, moving the electrospray tip and the aerodynamic ion focusing device 10 axially together so that the capillary inlet 26 was axially positioned from 25.5 mm inside the exit aperture 16 to 8.5 mm outside the exit aperture. It was discovered that that when the electrospray tip was axially positioned 6 mm inside the entrance aperture 12 of the aerodynamic ion focusing device 10 and the capillary inlet 26 was axially disposed 22.5 mm inside the exit aperture 16, the ion intensity reached its peak value.

Figures 6A, 6B, 6C:
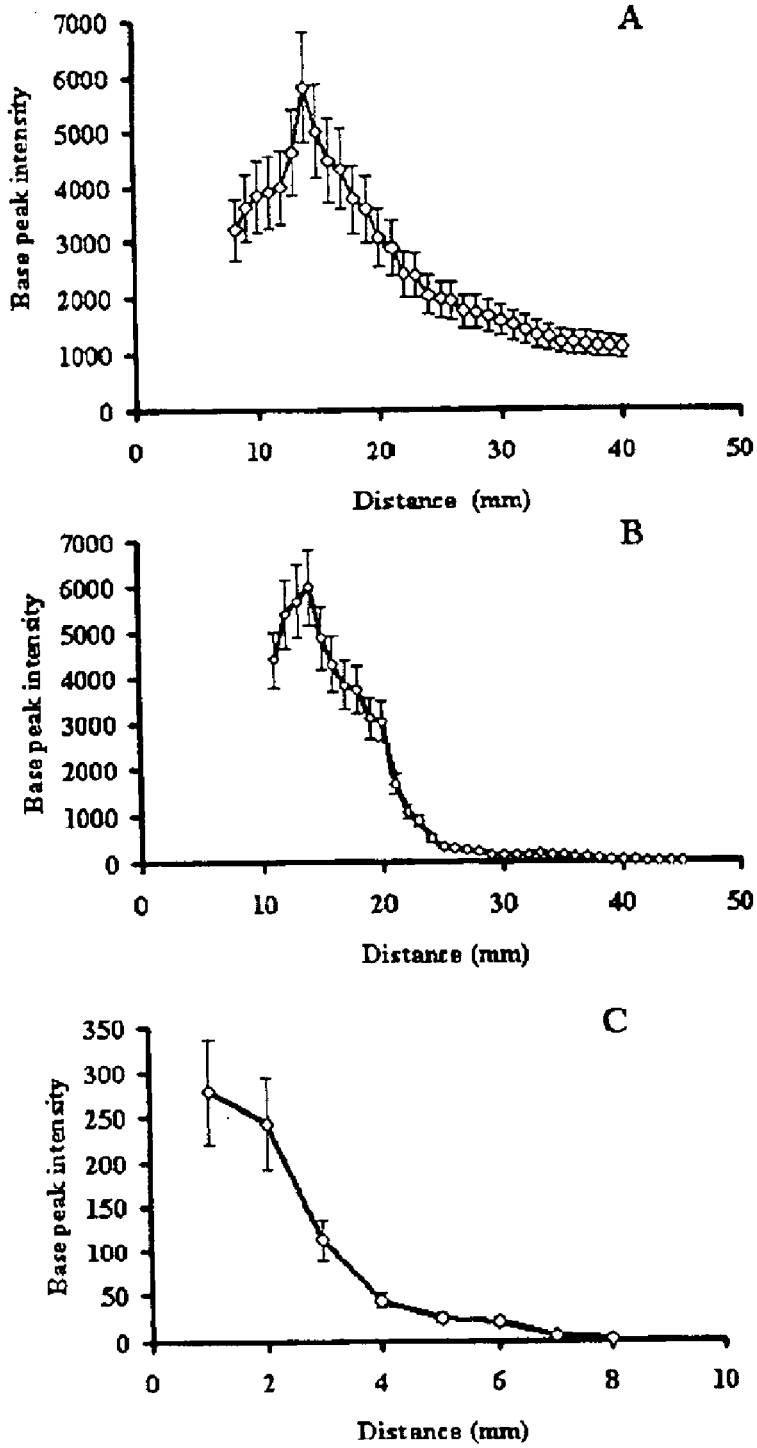
FIG. 6A is a graph showing the base peak intensity as a function of distance between the electrospray tip and the capillary inlet.
FIG. 6B is a graph showing the base peak intensity as a function of distance between the electrospray tip and the capillary inlet.
FIG. 6C is a graph showing the base peak intensity as a function of distance between the electrospray tip and the capillary inlet, but without the aerodynamic ion focusing device.

The results of these two experiments are illustrated in FIGS. 6A and 6B. FIG. 6A shows the base peak intensity as a function of distance between the electrospray tip and the capillary inlet 26 when the nozzle was axially fixed 22.5 mm inside the exit aperture 16 of the aerodynamic ion focusing device 10. FIG. 6B illustrates the base peak intensity as a function of distance between the electrospray tip and the capillary inlet 26 when the electrospray tip was axially fixed 6 mm inside the entrance aperture 12.

Furthermore, a relatively broad range of electrospray tip and capillary inlet 26 positions was found for maintaining strong ion signal intensities. Even when the distance between the electrospray tip and the capillary inlet 26 was 20 mm, the ion intensity was still higher when the electrospray tip was disposed 1 mm in front of the sampling orifice 22 without the aerodynamic ion focusing device 10, as shown in FIG. 6C.

Figures 7A, 7B:
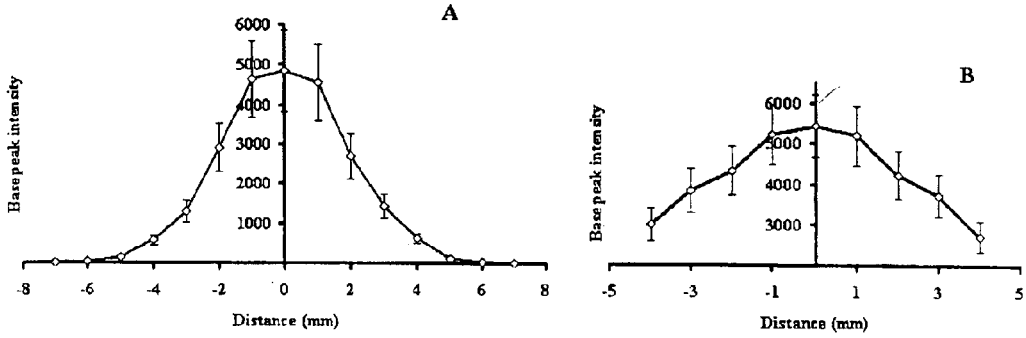
FIG. 7A is a graph of ion intensity when the electrospray tip was moved off-axis by +/−2 mm while the capillary inlet was axially fixed.
FIG. 7B is a graph of ion intensity when the capillary inlet was moved off-axis by +/−2 mm while the electrospray tip was axially fixed.

To evaluate the relationship between ion intensity and off-axis distance of the electrospray tip or the capillary inlet from their optimum positions, each was moved off-axis while the other was axially fixed in its optimum position. When the electrospray tip was moved off-axis by +/−2 mm while the capillary inlet was axially fixed, the ion intensity decreased by 40% as shown in FIG. 7A. When the capillary inlet was moved off-axis by +/−2 mm while the electrospray tip was axially fixed, the ion intensity decreased by 19% as shown in FIG. 7B. Very little loss in ion signal intensity was observed when the electrospray tip or the capillary inlet was moved +/−1 mm off axis.

Figure 8:
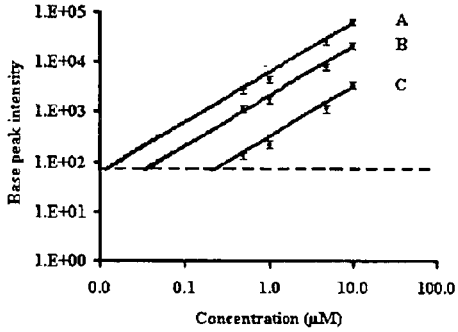
FIG. 8 is a graph of the base peak intensity as plotted against concentration with the aerodynamic ion focusing device in its optimum position.

Finally, the base peak intensity was plotted against concentration with the aerodynamic ion focusing device 10 in its optimum position as illustrated in FIG. 8. After linear regression, the method detection limits were calculated on the basis of concentrations corresponding to three times the signal-to-noise ratio. A 34-fold improvement in method detection limit was obtained. In addition to enhancing analyte ion intensity, the aerodynamic ion focusing device 10 also suppresses background chemical noise.

Any gain in ion signal intensity is attributed to the ability of the aerodynamic ion focusing device 10 to stabilize the electrospray and improve conduction of ions into the ion detection device 20. The electrospray tip can be located farther from the sampling orifice 22 than for conventional electrospray to produce better desolvation and less possibility of discharge. Another advantage of the aerodynamic ion focusing device 10 is that the electrospray can be positioned along the axial direction straight toward the capillary inlet 26. Complex devices with off-axis orientation of the electrospray tip with respect to the capillary inlet 26 for separating ions from neutrals and improving desolvation are not necessary.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. An aerodynamic ion focusing device for improving delivery of ions to an ion detector, said device comprising:

an entrance aperture;

an exit aperture;

at least one gas delivery aperture disposed between a receiving end of the entrance aperture and a delivery end of the exit aperture;

a chamber disposed around the at least one gas delivery aperture;

a gas inlet into the chamber that enables delivery of a gas through the at least one gas delivery aperture and along an interior surface of the exit aperture, wherein a gas delivered through the gas inlet to the exit aperture causes ions received at the entrance aperture to be concentrated along a trajectory that is determined by the gas that is forced out through the exit aperture.

2. The aerodynamic ion focusing device as defined in claim 1 wherein the entrance aperture has a frustoconical shape having a larger aperture at a receiving end that narrows to a smaller aperture at a delivery end thereof.

3. The aerodynamic ion focusing device as defined in claim 1 wherein the entrance aperture has a cylindrical shape.

4. The aerodynamic ion focusing device as defined in claim 1 wherein the exit aperture is disposed coaxially with respect to the entrance aperture.

5. The aerodynamic ion focusing device as defined in claim 1 wherein the exit aperture has a frustoconical shape having a smaller aperture at the receiving end that widens to a larger aperture at a delivery end thereof.

6. The aerodynamic ion focusing device as defined in claim 1 wherein the exit aperture has a cylindrical shape.

7. The aerodynamic ion focusing device as defined in claim 1 wherein the chamber disposed around the at least one gas delivery aperture is also annular to thereby assist in creating an equalized and smooth flow of a gas through the at least one gas delivery aperture and out the exit aperture.

8. The aerodynamic ion focusing device as defined in claim 7 wherein the at least one gas delivery aperture is an annular gap.

9. The aerodynamic ion focusing device as defined in claim 1 wherein the entrance aperture further comprises being constructed of materials that are at least partially electrically conductive, to enable a voltage to be applied thereto, and thereby resulting in a voltage gradient being created along a length thereof.

10. The aerodynamic ion focusing device as defined in claim 1 wherein the entrance aperture further comprises being constructed of materials that are at least partially electrically conductive, wherein the degree of electrical conductivity of an interior surface of the entrance aperture is varied along a length thereof in order to create a voltage gradient along the length of the entrance aperture when a voltage is applied thereto.

11. A method for improving delivery of ions to an ion detector, said method comprising the steps of:

(1) providing an aerodynamic ion focusing device that generates a non-diverging gas flow into an entrance aperture to thereby concentrate ions that are expelled from the aerodynamic ion focusing device such that the ions are concentrated along a desired trajectory; and (2) delivering ions to the aerodynamic ion focusing device such that the ions can be concentrated along the desired trajectory.

12. The method as defined in claim 11 wherein the method further comprises the step of generating a converging gas flow at the entrance aperture.

13. The method as defined in claim 11 wherein the method further comprises the step of generating a concentric gas flow at the entrance aperture.

14. The method as defined in claim 11 wherein the method further comprises the steps of:

(1) providing an annular gas inlet so that a gas flow can be injected into the aerodynamic ion focusing device; and (2) enabling the gas flow to be subject to the coanda effect such that the gas travels along an interior surface of the exit aperture as the gas is caused to flow therefrom.

15. The method as defined in claim 14 wherein the method further comprises the step of enabling the gas flow to affect the concentration distribution of ions that are expelled from the aerodynamic ion focusing device.

16. The method as defined in claim 15 wherein the method further comprises the step of creating a voltage gradient at an entrance aperture of the aerodynamic ion focusing device, wherein the voltage gradient increases along a length thereof, wherein electrical potential is weakest at a receiving end of the entrance aperture, and strongest at a delivery end of the entrance aperture.

17. The method as defined in claim 16 wherein the method further comprises the step of applying voltage to the aerodynamic ion focusing device to thereby concentrate ions that are delivered to the entrance aperture along a desired trajectory through the entrance aperture of the aerodynamic ion focusing device.

18. The method as defined in claim 17 wherein the method further comprises the step of making the entrance aperture a frustoconical shape having a larger aperture at the receiving end that narrows to a smaller aperture at the delivery end to thereby cause the electrical potential to increase from the receiving end to the delivery end.

19. The method as defined in claim 17 wherein the method further comprises the step of varying the conductivity of material used in construction of the entrance aperture to thereby vary the voltage along a length of the entrance aperture when a voltage is applied to at least a portion of the entrance aperture.

20. The method as defined in claim 19 wherein the method further comprises the step of decreasing the conductivity of materials used in construction of the entrance aperture when moving from the receiving end to the delivery end thereof.

21. The method as defined in claim 11 wherein the method further comprises the step of applying a voltage along at least a portion of an entrance aperture to thereby counter the effects of space-charge repulsion of ions being received by the aerodynamic ion focusing device and delivered to an ion detector.

22. The method as defined in claim 11 wherein the method further comprises the steps of:

(1) applying a voltage along a length of an entrance aperture to thereby concentrate ions along a desired trajectory into the aerodynamic ion focusing device because of the resulting voltage gradient; and (2) increasing the number of ions that can be delivered to an ion detector.

23. The method as defined in claim 11 wherein the method further comprises the steps of:

(1) providing an entrance aperture;

(2) making the exit aperture coaxial with respect to the entrance aperture;

(3) providing an annular gap between a delivery end of the entrance aperture and a receiving end of the exit aperture;

(4) disposing a chamber around the annular gap; and (5) providing a gas inlet into the chamber that enables delivery of the gas through the annular gap and along an interior surface of the exit aperture, wherein the gas delivered through the gas inlet to the exit aperture causes ions delivered at the entrance aperture to be concentrated along a desired trajectory at the exit aperture.

* * * * *